US008950745B2

(12) United States Patent
Takahashi

(10) Patent No.: US 8,950,745 B2
(45) Date of Patent: Feb. 10, 2015

(54) IMAGE FORMING APPARATUS WITH ALIGNMENT UNIT

(75) Inventor: Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 13/160,341

(22) Filed: Jun. 14, 2011

(65) Prior Publication Data

US 2012/0020715 A1 Jan. 26, 2012

(30) Foreign Application Priority Data

Jul. 22, 2010 (JP) ..... 2010-165304

(51) Int. Cl.
*B65H 31/36* (2006.01)
*G03G 15/00* (2006.01)

(52) U.S. Cl.
CPC .. *G03G 15/6538* (2013.01); *G03G 2215/00751* (2013.01); *G03G 2215/00911* (2013.01)
USPC ..... 271/221; 270/58.27

(58) Field of Classification Search
CPC ..... B65H 31/34; B65H 31/36; B65H 31/38; B65H 31/40; B65H 2301/142; B65H 2301/212
USPC ..... 271/210, 221; 270/58.12, 58.16, 58.17, 270/58.27
See application file for complete search history.

(56) References Cited

U.S. PATENT DOCUMENTS

| | | | | |
|---|---|---|---|---|
| 4,452,440 | A * | 6/1984 | Fagan et al. | 271/4.1 |
| 5,622,359 | A * | 4/1997 | Kawano et al. | 270/58.12 |
| 6,264,189 | B1 * | 7/2001 | Kawata | 271/176 |
| 6,398,203 | B1 * | 6/2002 | Saito et al. | 270/58.12 |
| 7,413,177 | B2 * | 8/2008 | Mori et al. | 270/58.09 |
| 7,566,051 | B2 * | 7/2009 | Kodama et al. | 270/58.12 |
| 7,694,966 | B2 * | 4/2010 | Nagasako et al. | 271/303 |
| 7,890,004 | B2 * | 2/2011 | Fujii et al. | 399/45 |
| 7,946,569 | B2 * | 5/2011 | Suzuki et al. | 270/58.12 |
| 7,984,897 | B2 * | 7/2011 | Williams et al. | 270/52.18 |
| 8,387,974 | B2 * | 3/2013 | Hayashi | 271/213 |
| 8,523,165 | B2 * | 9/2013 | Kunieda et al. | 270/58.06 |
| 2003/0006548 | A1 * | 1/2003 | Murata et al. | 271/256 |
| 2006/0071410 | A1 * | 4/2006 | Koie | 271/207 |
| 2007/0235917 | A1 * | 10/2007 | Nagasako et al. | 270/58.08 |
| 2008/0067730 | A1 * | 3/2008 | Suzuki et al. | 270/37 |
| 2008/0211160 | A1 * | 9/2008 | Sugizaki | 270/58.07 |
| 2008/0317530 | A1 * | 12/2008 | Taki et al. | 399/367 |
| 2009/0014949 | A1 * | 1/2009 | Ichihashi et al. | 271/278 |
| 2009/0258774 | A1 * | 10/2009 | Suzuki et al. | 493/442 |
| 2011/0064541 | A1 * | 3/2011 | Kikkawa et al. | 412/13 |

FOREIGN PATENT DOCUMENTS

| | | | |
|---|---|---|---|
| JP | S60-026544 | A | 2/1985 |
| JP | 2004-85982 | A | 3/2004 |
| JP | 2008-214102 | A | 9/2008 |
| JP | 2010-168125 | A | 8/2010 |
| JP | 2010168125 | A * | 8/2010 |
| JP | 2010-260660 | A | 11/2010 |

* cited by examiner

*Primary Examiner* — Jeremy R Severson
(74) *Attorney, Agent, or Firm* — Canon USA, Inc., IP Division

(57) ABSTRACT

An image forming apparatus may include an image forming unit, a stacking unit, a control unit, and an alignment unit. The image forming unit forms an image on a recording material having a type. The stacking unit stacks the recording material on which the image formation is formed by the image forming unit. The control unit sets a predetermined number of sheets to a number that corresponds to the type of the recording material. The alignment unit aligns the recording material if the predetermined number of sheets of the recording material is stacked by the stacking unit.

9 Claims, 9 Drawing Sheets

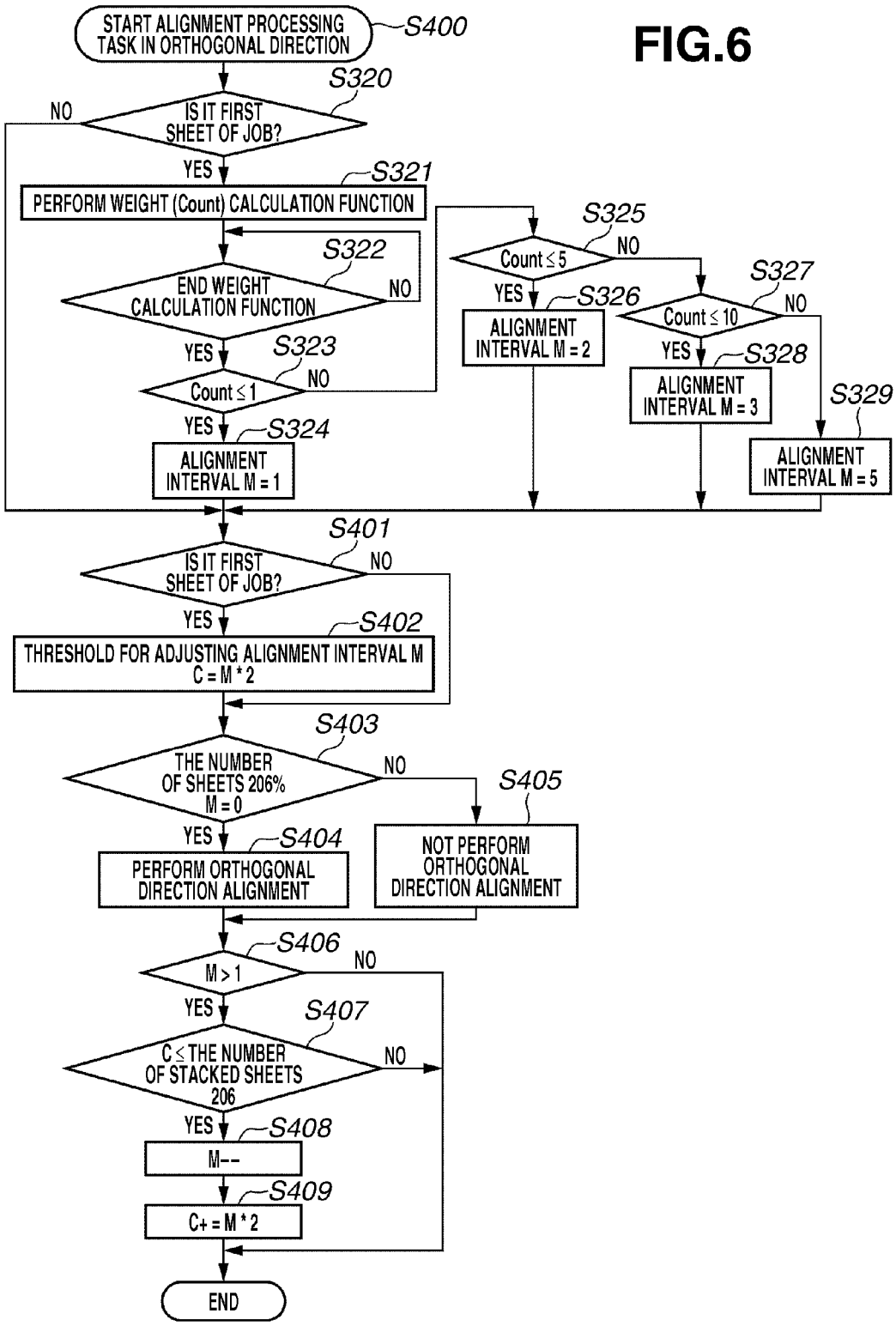
FIG.6
START ALIGNMENT PROCESSING TASK IN ORTHOGONAL DIRECTION
S400
S320
IS IT FIRST SHEET OF JOB?
NO
YES
S321
PERFORM WEIGHT (Count) CALCULATION FUNCTION
S322
END WEIGHT CALCULATION FUNCTION
NO
YES
S323
Count ≤ 1
NO
YES
S324
ALIGNMENT INTERVAL M = 1
S325
Count ≤ 5
NO
YES
S326
ALIGNMENT INTERVAL M = 2
S327
Count ≤ 10
NO
YES
S328
ALIGNMENT INTERVAL M = 3
S329
ALIGNMENT INTERVAL M = 5
S401
IS IT FIRST SHEET OF JOB?
NO
YES
S402
THRESHOLD FOR ADJUSTING ALIGNMENT INTERVAL M
C = M * 2
S403
THE NUMBER OF SHEETS 206%
M = 0
NO
YES
S404
PERFORM ORTHOGONAL DIRECTION ALIGNMENT
S405
NOT PERFORM ORTHOGONAL DIRECTION ALIGNMENT
S406
M > 1
NO
YES
S407
C ≤ THE NUMBER OF STACKED SHEETS
206
NO
YES
S408
M--
S409
C+ = M * 2
END

IMAGE FORMING APPARATUS WITH ALIGNMENT UNIT

BACKGROUND OF THE INVENTION

1. Field of the Invention

The present invention relates to an image forming apparatus having a post-processing device for aligning a plurality of sheets of recording material and performing predetermined post-processing.

2. Description of the Related Art

In conventional image forming apparatuses, some apparatuses have a post-processing device for aligning a plurality of sheets of recording material on which image formation is performed, performing post-processing such as stapling, and punching, and for discharging them. In such post-processing devices, the image formation is performed in a main body of the image forming apparatus, and the plurality of sheets of discharged recording material are received and stacked. The stacked recording materials are aligned by an alignment member. On the aligned recording materials, post-processing such as stapling and punching is performed, and the recording materials are discharged.

For such post-processing devices, Japanese Patent Application Laid-Open No. 2004-85982 has proposed a method for controlling an alignment position (movement distance of an alignment member) or an alignment speed (movement speed of the alignment member) depending on the type of the paper (thickness and surface properties) in order to prevent alignment failure or stacking failure due to a difference between friction force on surfaces of the recording materials.

In Japanese Patent Application Laid-Open No. 2004-85982, when stacked recording materials are aligned by the post-processing device, the alignment position (movement distance of the alignment member) or the alignment speed (movement speed of the alignment member) is controlled depending on the type of the paper, and each time a sheet of recording material is stacked, the alignment processing is performed once or several times.

However, depending on the type of the recording material or environmental conditions, if the alignment processing is performed each time a sheet of recording material is stacked, static electricity is produced due to friction between the recording material and the alignment member. As a result, the alignment performance is reduced. FIG. 8 illustrates an example of the alignment member in the post-processing device. The alignment member illustrated in FIG. 8 aligns the recording materials by moving in the arrow directions in the drawing. When the recording materials are aligned by such an alignment member, due to the friction between the alignment member and the recording material, the static electricity is produced. Then, static clinging may occur between the alignment member and the recording material. Especially, if the contact area between the alignment member and the recording material increases, a greater amount of the static electricity is produced. Accordingly, it is highly possible that the static clinging between the alignment member and the recording material occurs. If the static clinging between the alignment member and the recording material occurs, as illustrated in FIG. 9, the recording materials are not correctly aligned, in other words, alignment failure occurs.

SUMMARY OF THE INVENTION

The present invention is directed to reducing alignment failure due to friction between an alignment member and a recording material.

According to an aspect of the present invention, an image forming apparatus includes an image forming unit configured to form an image on a recording material having a type; a stacking unit configured to stack the recording material on which the image formation is formed by the image forming unit; a control unit configured to set a predetermined number of sheets to a number that corresponds to the type of the recording material; and an alignment unit configured to align the recording material if the predetermined number of sheets of the recording material is stacked by the stacking unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a flowchart illustrating an alignment processing task in the orthogonal direction according to a second exemplary embodiment.

DESCRIPTION OF THE EMBODIMENTS

Various exemplary embodiments, features, and aspects of the invention will be described in detail below with reference to the drawings.

Note that the following embodiments do not limit the invention recited in the claims. Further, all combinations of features described in the embodiments are not necessarily essential to the solution presented by present invention. In an example, an image forming apparatus can reduce static clinging to an alignment member caused by electrostatic charge of a recording material due to alignment processing and can reduce alignment failure of the recording material by controlling the number of sheets of the recording material stacked until the alignment processing is performed depending on the type of the recording material, the states of the environment, or the number of stacked sheets.

Figure 1:
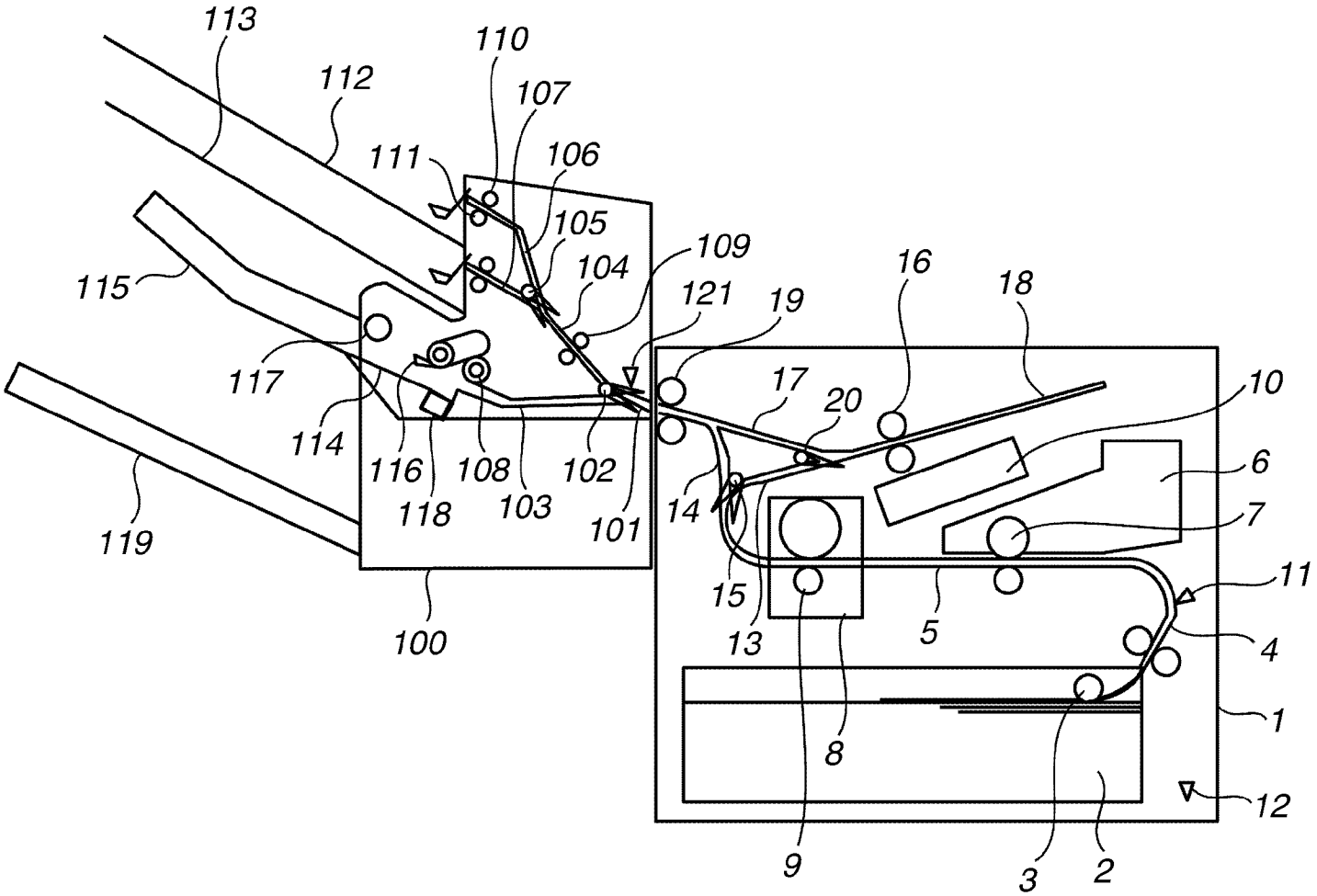
FIG. 1 illustrates a schematic configuration of an image forming apparatus.

Hereinafter, the first exemplary embodiment is described. FIG. 1 illustrates a schematic configuration of an image forming apparatus. Each unit in the image forming apparatus 1 is described below. A sheet feeding cassette 2 stacks paper that is a recording material. A sheet feeding roller 3 feeds the recording material stacked in the sheet feeding cassette 2.

Conveyance paths 4 and 5 convey the recording material. An optical unit 10 forms a latent image on a photosensitive drum. An image forming unit 6 develops the latent image formed on the photosensitive drum with developer, and forms an image. A photosensitive drum 7 carries the image formed on the surface and transfers the image on the recording material. A fixing device 8 heats and fixes the image transferred on the recording material. A media sensor 11 detects the type of the recording material. An environment sensor 12 detects temperature and humidity as an environment where the image forming apparatus is installed. To a side surface of the main body of the image forming apparatus 1, a post-processing device 100 is provided.

To the image forming apparatus 1, the post-processing device 100 is connected, to which the image-formed recording material is discharged, and which aligns a bundle of recording materials and performs stapling, and the like. In order to discharge the recording material to an inlet unit 101 of the post-processing device 100, the image forming apparatus 1 is provided with two discharge paths. The two discharge paths include a first conveyance path 13 for carrying the recording material to an upper part of a write scanner 10, reversing the recording material, and discharging the recording material to the post-processing device 100, and a second conveyance path 14 for directly discharging the recording material to the post-processing device 100. The first conveyance path 13 and the second conveyance path 14 are switched by a FD/FU flapper 15 that is provided in a downstream side of the fixing device 8.

The post-processing device 100 is described. The inlet unit 101 receives the recording material from the image forming apparatus 1. In the downstream side of the inlet unit 101, a flapper 102 that selectively switches the conveyance path to one of a third conveyance path 103 and a fourth conveyance path 104 to convey the recording material is provided. In the downstream side of the forth conveyance path 104, further, a flapper 105 that selectively switches the conveyance path to one of a fifth conveyance path 106 or a sixth conveyance path 107 to convey the recording material is provided.

A case where the recording material is conveyed to the fourth conveyance path 104 is described. The recording material is conveyed to the flapper 105 by a discharge roller pair 109. The flapper 105 selectively switches the conveyance path to one of the fifth conveyance path 106 or the sixth conveyance path 107 to convey the recording material. If the recording material is conveyed to the fifth conveyance path 106, the recording material is discharged to a stack tray 112 by a discharge roller pair 110. If the recording material is conveyed to the sixth conveyance path 107, the recording material is discharged to a stack tray 113 by a discharge roller pair 111.

Next, a case where the recording material is conveyed to the third conveyance path 103 is described. The recording material is conveyed to an intermediate stacking unit 114 on which the recording material is temporarily stacked by a discharge roller 108. The recording material is held at both end portions in the width direction, and conveyed to an alignment member (hereinafter, also referred to as jogger) 115. The jogger 115 aligns the stacked recording materials in a direction orthogonal to the conveyance direction of the recording materials. The intermediate stacking unit 114 includes a binding unit 118 (hereinafter, also referred to as stapler) for binding a bundle of the aligned recording materials. The bundle of the recording materials aligned by the jogger 115 and stapled by the stapler 118 is discharged onto a stack tray 119.

Figure 2:
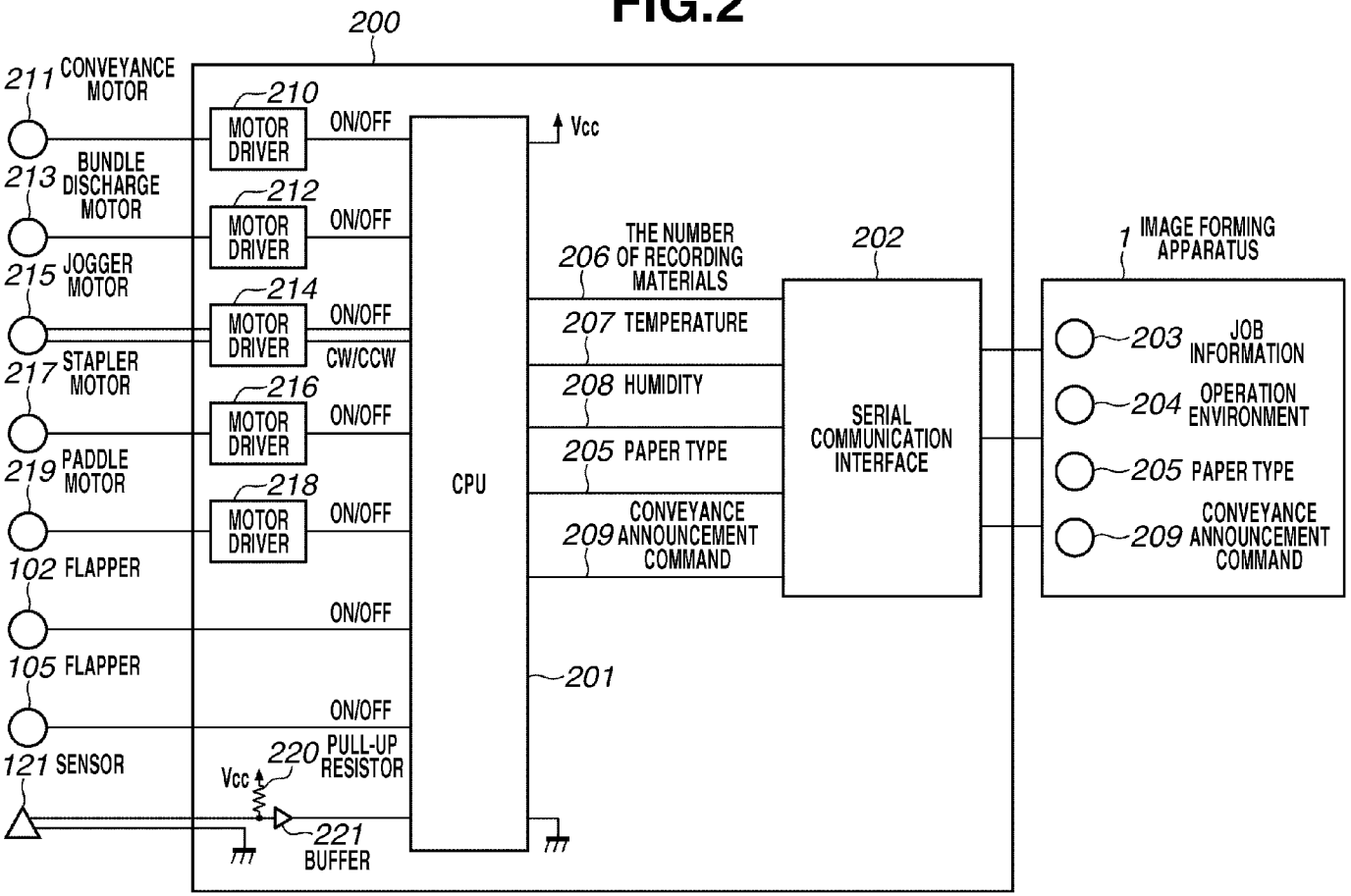
FIG. 2 is a block diagram illustrating a control unit for controlling a post-processing device.

FIG. 2 is a block diagram illustrating a control unit for controlling the post-processing device 100. In the description, as an example, it is assumed that the control unit is provided in the post-processing device 100. However, the control unit can be provided in the image forming apparatus 1. A control unit 200 includes a central processing unit (CPU) 201. The CPU 201 communicates with the image forming apparatus 1 via a serial communication interface 202. The serial communication interface 202 and the image forming apparatus 1 communicate with each other information, for example, job information 203, operation environment 204, the type of paper (hereinafter, referred to as paper type) 205, and a conveyance announcement command 209. The serial communication interface 202 transmits to the CPU 201 the paper type 205, the number of stacked sheets 206, which is the number of sheets of the recording material stacked on the jogger), a temperature 207, a humidity 208, the conveyance announcement command 209, or the like by using the information received from the image forming apparatus 1.

To output terminals of the CPU 201, motor drivers 210, 212, 214, 216, and 218 are connected. The motor driver 210 drives a conveyance motor 211. In response to the rotation of the conveyance motor 211, a discharge roller 108 and discharge roller pairs 109, 110 and 111 rotate, and the recording material is conveyed. The motor driver 212 drives a bundle discharge motor 213. In response to the rotation of the bundle discharge roller 213, the discharge roller 117 rotates, and the recording material is conveyed. The motor driver 214 drives a jogger motor 215. In response to the positive rotation (clockwise (CW) direction) of the jogger motor 215, the jogger 115 closes, and alignment of the recording materials is performed. In response to the negative rotation (counter-clockwise (CCW) direction) of the jogger motor 215, the jogger 115 opens, and the alignment of the recording materials is not performed. The motor driver 216 drives a stapler motor 217. In response to the rotation of the stapler motor 217, the stapler 118 performs stapling. The motor driver 218 drives a paddle motor 219. In response to the rotation of the paddle motor 219, a conveyance direction alignment paddle 116 performs alignment of the recording materials in the conveyance direction.

To an output terminal of the CPU 201, the flapper 102 is connected. If an ON signal is output from the CPU 201, the flapper 102 is switched such that the recording material is conveyed to the fourth conveyance path 104. If an OFF signal is output, the flapper 102 is switched such that the recording material is conveyed to the third conveyance path 103. To an output terminal of the CPU 201, the flapper 105 is connected. If an ON signal is output from the CPU 201, the flapper 105 is switched such that the recording material is conveyed to the sixth conveyance path 107. If an OFF signal is output, the flapper 105 is switched such that the recording material is conveyed to the fifth conveyance path 106. A sensor 121 uses a pull-up resistor 220, and via a buffer 221, inputs the state of the sensor to the CPU 201.

Figure 3:
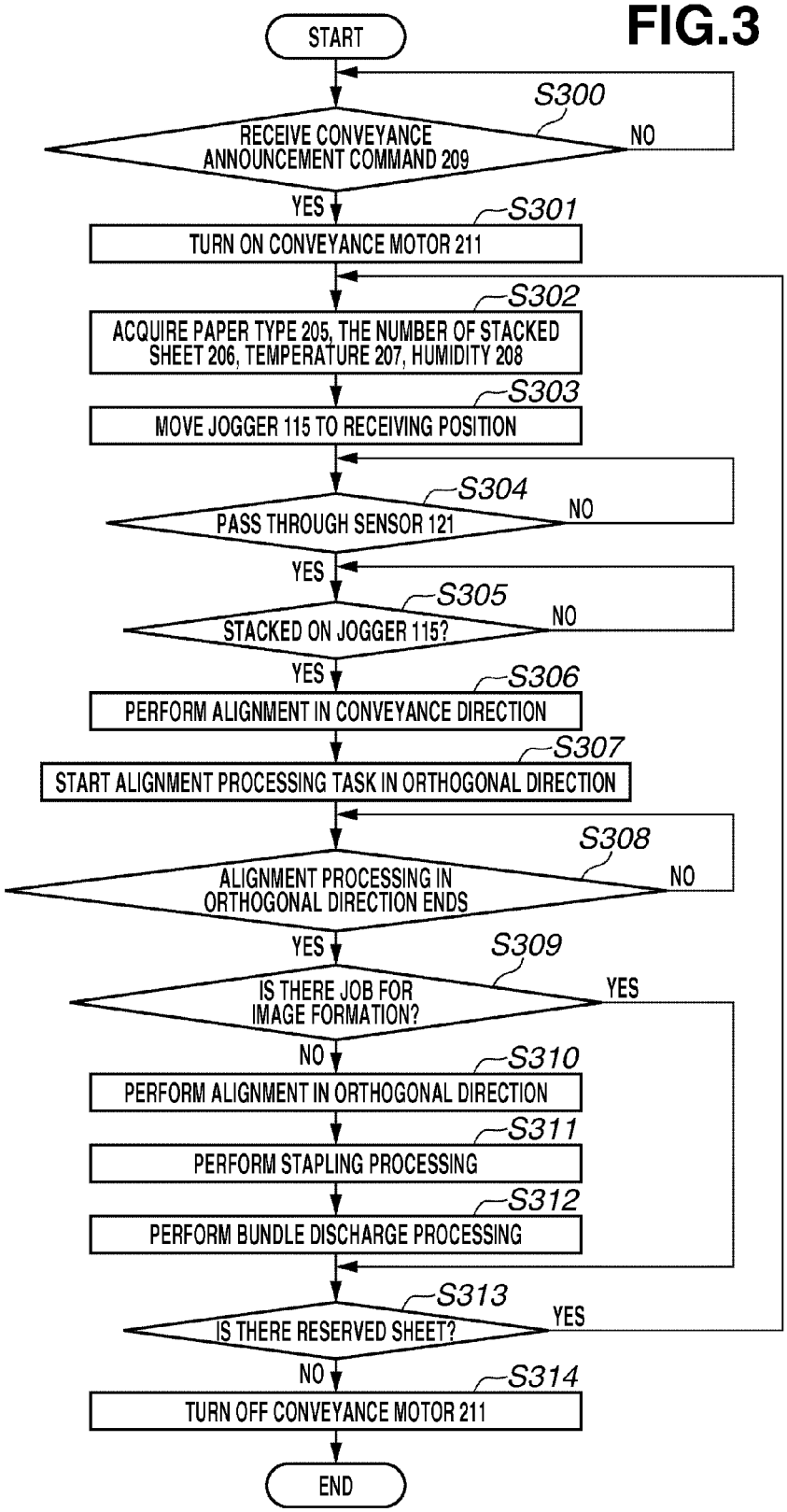
FIG. 3 is a flowchart illustrating processing for performing stapling by the post-processing device.

With reference to the flowchart in FIG. 3, the processing of stapling performed by the post-processing device 100 is described. In step S300, the CPU 210 receives the conveyance announcement command 209 for notifying that the recording material is to be discharged from the image forming apparatus 1 to the post-processing device 100. In step S301, the CPU 201 drives the conveyance motor 211 and prepares for the conveyance of the recording material. In step S302, the CPU 201 receives the paper type 205 that has been detected by the media sensor 11 in the image forming apparatus 1, the number of stacked sheets 206 which is the number of sheets of the recording material stacked on the jogger 115, the temperature 207, and the humidity 208. In step S303, the CPU 201 moves the jogger 115 to a receiving position in order to receive the recording material.

In step S304, the CPU 201 checks whether the recording material has passed through the sensor 121. If the CPU 201 checks that the recording material has passed through the sensor 121 (YES in step S304), in step S305, the CPU 201 checks whether the recording material is stacked on the jogger 115. If the recording materials of the predetermined number of sheets are stacked (YES in step S305), in step S306, the jogger 115 performs alignment in the conveyance direction of the recording materials. In step S307, the CPU 201 starts an alignment processing task for determining whether to perform the alignment in the direction (hereinafter, referred to as orthogonal direction) orthogonal to the conveyance direction. The determination whether to perform the alignment in the orthogonal direction by the alignment processing task is described in detail with reference to the flowchart in FIG. 4.

In step S308, the CPU 201 checks whether the alignment processing in the orthogonal direction has ended. If the alignment processing task determines that the alignment is not necessary, it is determined that the alignment processing ended. After the alignment processing has ended (YES in step S308), in step S309, the CPU 201 checks whether a job for subsequently performing the image formation exists. If there is not a job (NO in step S309), in step S310, the CPU 201 performs the alignment processing in the orthogonal direction. In step S311, the CPU 201 performs the stapling processing. In step S312, the CPU 201 performs the paper bundle discharge processing. In step S313, the CPU 201 checks whether a reserved recording material whose conveyance announcement command 209 has been received but has not passed through the sensor 121 exists. If the reserved recording material exists (YES in step S313), the processing returns to step S302. If the reserved recording material does not exist (NO in step S313), in step S314, the conveyance motor 211 is stopped and the processing for performing the stapling processing ends.

Figure 4:
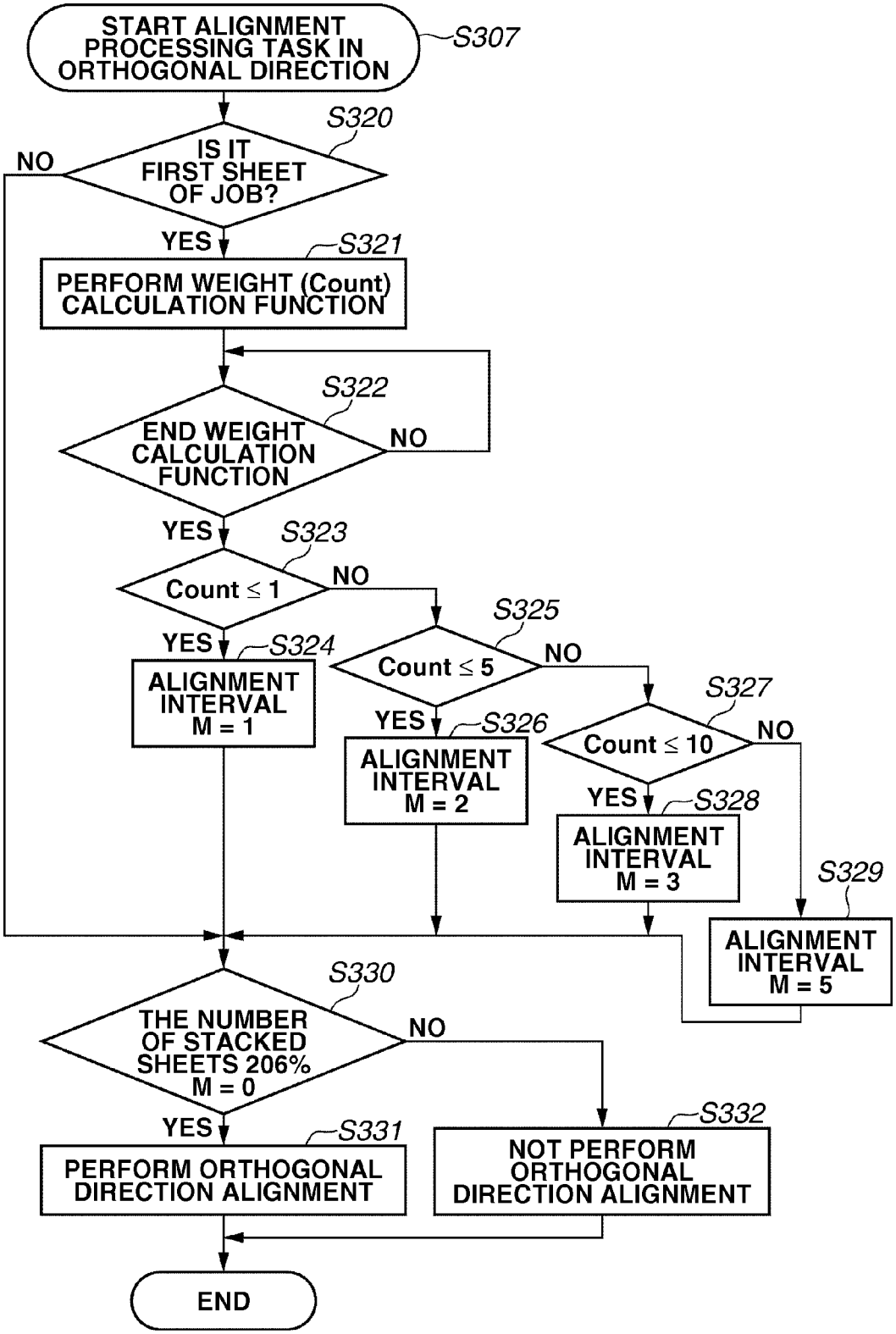
FIG. 4 is a flowchart illustrating an alignment processing task in the orthogonal direction according to a first exemplary embodiment.

With reference to the flowchart in FIG. 4, the alignment processing task in the orthogonal direction in step S307 in FIG. 3 is described. In step S307, the CPU 201 starts the alignment processing task. In step S320, the CPU 201 checks whether the paper is a first sheet of the started job of image formation. If the paper is the first sheet of the job (YES in step S320), in step S321, the CPU 201 performs a weight calculation function for determining whether to perform the alignment processing. If the paper is not the first sheet of the job (NO in step S320), the processing proceeds to step S330. In step S321, using the weight calculation function, the CPU 201 calculates weight (hereinafter, referred to as Count) on the basis of the paper type 205, the temperature 207, and the humidity 208 received from the image forming apparatus 1. A specific weight calculation method by the weight calculation function is described in detail with reference to the flowchart in FIG. 5.

In step S322, the CPU 201 checks whether the weight calculation ended. In step S323, the CPU 201 determines whether Count (the calculated weight)≤1. If Count≤1 (YES in step S323), in step S324, the CPU 201 sets an alignment interval M (hereinafter, referred to as M) to 1. The alignment interval M is a value that indicates whether the alignment in the orthogonal direction is to be performed when the predetermined number of sheets of the recording material is stacked. The alignment interval M is used as a determination criterion for performing the alignment when the recording materials of the value of the alignment interval M are stacked. More specifically, the predetermined number of sheets for performing the alignment processing is set by the alignment interval M. If Count>1 (NO in step S323), in step S325, the CPU 201 determines whether Count≤5. If Count≤5 (YES in step S325), in step S326, the CPU 201 sets the alignment interval M to 2. If Count>5 (NO in step S325), in step S327, the CPU 201 determines whether Count≤10. If Count≤10 (YES in step S327), in step S328, the CPU 201 sets the alignment interval M to 3. If Count>10 (NO in step S327), in step S329, the CPU 201 sets the alignment interval M to 5.

If the calculation of the weight is performed and the alignment interval M is set, in step S330, the CPU 201 determines whether the number of stacked sheets 206 reaches the value M. If the number of stacked sheets 206 reaches the value M (YES in step S330), in step S331, the CPU 201 performs the alignment in the orthogonal direction. If the number of stacked sheets 206 has not reached the value M (NO in step S330), in step S332, the CPU 201 does not perform the alignment in the orthogonal direction.

Figure 5:
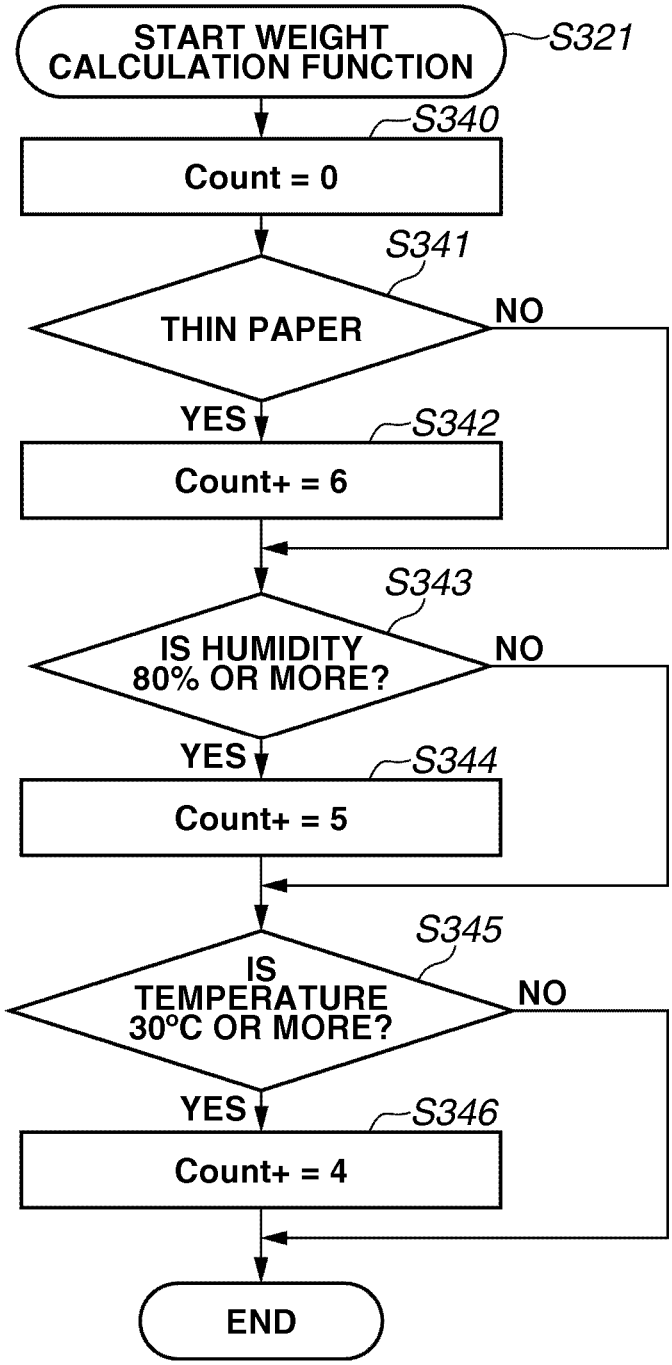
FIG. 5 is a flowchart illustrating a method of calculating weight using a weight calculation function.
Figure 8:
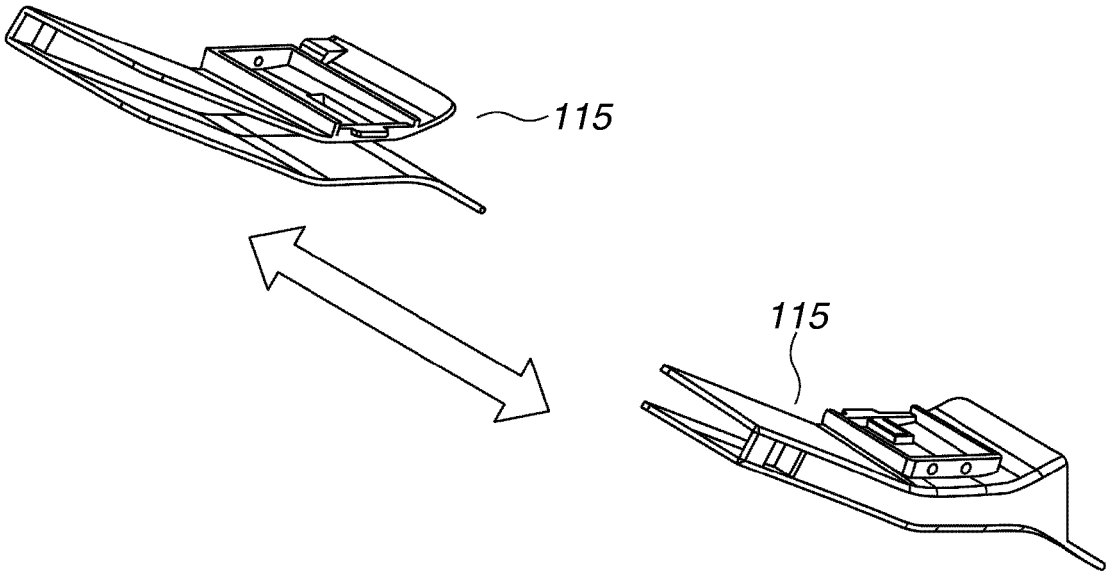
FIG. 8 illustrates an example of an alignment member in a post-processing device.
Figure 9:
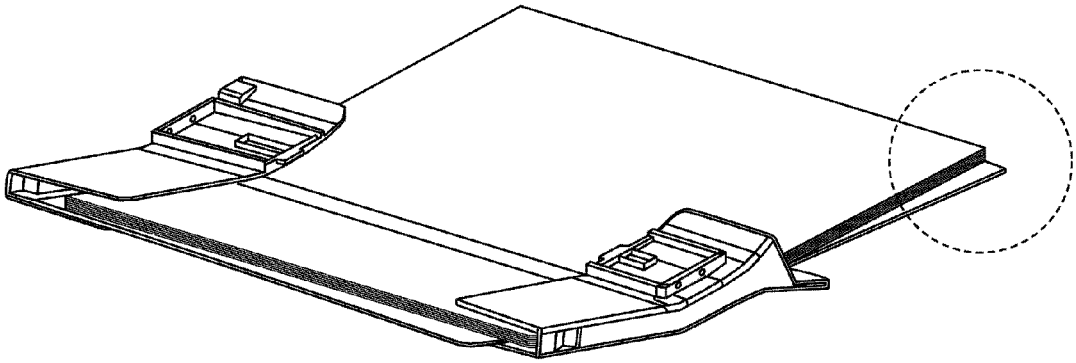
FIG. 9 illustrates an example of alignment failure in which recording materials are not correctly aligned.

With reference to the flowchart in FIG. 5, the above-described weight calculation method using the weight calculation function in step S321 in FIG. 4 is described. In step S340, the CPU 201 initializes the value of Count. In step S341, the CPU 201 checks whether the recording material on which the image formation is performed is thin paper by the paper type 205 received from the image forming apparatus 1. If the recording material is thin paper (YES in step S341), in step S342, the CPU 201 adds 6 to Count as the weight indicating that the recording material is the thin paper. If the recording material is not thin paper (NO in step S341), the addition to the value of Count is not performed. Here, the example of the thin paper for the type of the recording material is described because the thinner the thickness of the recording material becomes, the more easily the recording material curls. For example, in the alignment member in FIG. 8, if the curving direction of the alignment member and the curling direction of the recording material are the same, the contact area becomes wide. Then, when the alignment processing is performed by the alignment unit, the recording material becomes electrically charged and it is highly possible that static clinging may occur. In the description, as one example, whether the recording material is the thin paper is used as the determination criterion. However, the determination criterion is not limited to the above, for example, in a case where a sensor for detecting grammage of the recording material is provided, the grammage of the recording material can be used as the determination criterion.

In step S343, the CPU 201 checks whether the humidity is 80% or more using the humidity 208 received from the image forming apparatus 1. If the humidity is 80% or more (YES in step S343), in step S344, the CPU 201 adds 5 to Count. If the recording material is less than 80% (NO in step S341), the addition of the value to Count is not performed. In the present case, the reference value of the humidity of 80% is described as an example because as the humidity becomes high, the recording material curls easily. For example, in the alignment member in FIG. 8, if the curving direction of the alignment member and the curling direction of the recording material are the same, the contact area becomes wide. Then, when the alignment processing is performed by the alignment unit, it is highly possible that static clinging may occur even with a small electric charge. In the present case, as one example, the determination criterion of 80% is described. However, the determination criterion is not limited to 80%. As long as the humidity can be determined to be high, the determination criterion can be set to a certain value. In step S345, the CPU 201 checks whether the temperature 207 received from the image forming apparatus 1 is 30° C. or more. If the temperature is 30° C. or more (YES in step S345), in step S346, the CPU 201 adds 4 to Count. If the temperature is less than 30° C. (NO in step S345), the addition of the value to Count is not performed. In the present case, the reference value of the temperature of 30° C. or more is described as an example. This is because when the alignment processing is performed by the alignment unit, if the temperature is high, it is highly possible that the recording material becomes electrically charged and static clinging may occur. In the present case, the determination criterion of 30° C. is described as one example. However, the determination criterion is not limited to 30° C. As long as the temperature is determined to be high, the determination criterion can be set to a certain value.

In the present case, as one example, it is determined whether a value is to be added to Count by checking only one reference of the paper type, the humidity, and the temperature. However, for example, determination criteria having a plurality of levels can be provided, and different values can be added to Count depending on the respective determination criteria. The values to be added to Count is one example, and the arbitrary values can be set. Further, in the present case, calculation of the Count values using the paper type, the humidity, and the temperature is described as one example. However, the Count values can be calculated using not only the three determination criteria but, for example, using only the paper type, or by adding more determination criteria such as the number of stacked sheets 206. In the case where the number of stacked sheets 206 is added to the conditions, if the number of stacked sheets 206 is 10 sheets or less, the Count value may be increased by one. The comparison condition of the number of stacked sheets 206 is not limited to 10 sheets.

Further, the paper type, the temperature, and the humidity are not limited to the values received from the image forming apparatus 1, but, for example, sensors that can detect the paper type, the temperature, or the humidity, can be provided in the post-processing device, and the Count values can be calculated using information detected by the sensors.

As described above, by controlling the number of sheets of the recording material stacked until the alignment processing is performed depending on the type of the recording material, the states of the environment, or the number of stacked sheets, static clinging to the alignment member caused by electrostatic charge of the recording material due to the alignment processing can be reduced, and the alignment failure of the recording material can be reduced.

In the first exemplary embodiment, in performing image formation on the recording material of the first sheet of the job, the static clinging to the alignment member due to electrostatic charge of the recording material is reduced by setting the alignment interval depending on the type of the recording material or the environment state. In the second exemplary embodiment, in consideration of the fact that the possibility of the alignment failure increases as the number of sheets of the recording material to be stacked increases, the alignment interval is changed depending on the number of sheets of the recording material stacked on the jogger 115. Descriptions of configurations similar to those in the above-described first exemplary embodiment are omitted.

With reference to the flowchart in FIG. 6, an alignment processing task in the orthogonal direction according to the second exemplary embodiment is described. The processing in steps S320 to S329 is similar to that in the flowchart in FIG. 4 according to the above-described first exemplary embodiment. Accordingly, the description of the processing is omitted.

In step S401, the CPU 201 checks whether the paper is the first sheet of the started job of the image formation. If it is the first sheet of the job (YES in step S401), in step S402, in order to set timing for adjusting the alignment interval M, the CPU 201 substitutes M×2 into a threshold C for comparing with the number of sheets of the stacked recording material. If it is not the first sheet of the job (NO in step S401), the processing in step S402 is skipped.

In step S403, the CPU 201 determines whether the number of stacked sheets 206 reaches the value M. If the number of stacked sheets 206 reaches the value M (YES in step S403), in step S404, the CPU 201 performs the alignment in the orthogonal direction. If the number of stacked sheets 206 has not reached the value M (NO in step S403), in step S405, the CPU 201 does not perform the alignment in the orthogonal direction. In step S406, the CPU 201 checks whether the alignment interval M is greater than one. If the value M is one or less (NO in step S406), the alignment interval cannot be narrowed further. Accordingly, the adjustment of the alignment interval is not performed. If the value M is greater than one (YES in step S406), in step S407, the CPU 201 checks whether the number of stacked sheets 206 is the threshold C or more. If the number of stacked sheets 206 is less than the threshold C (NO in step S407), the change of the alignment interval M is not performed. If the number of stacked sheets 206 is the threshold C or more (YES in step S407), in step S408, the CPU 201 decrements the alignment interval M. Here, as one example, the method of decrementing the alignment interval by one is described. However, it is not limited to the above. As long as the alignment interval M is not one or less, the alignment interval M can be decremented by 2 or more. In step S409, using the alignment interval M adjusted in step S408, the CPU 201 adds M×2 to the threshold C in order to set timing for adjusting the alignment interval M next time.

As described above, by controlling the number of stacked sheets of the recording material until the alignment processing is performed depending on the number of sheets of the recording material stacked on the alignment member in addition to the type of the recording material and the states of the environment, static clinging to the alignment member caused by electrostatic charge of the recording material due to the alignment processing can be reduced, and the alignment failure of the recording material can be reduced.

In the first and second exemplary embodiments, static clinging to the alignment member caused by electrostatic charge of the recording material is reduced by setting the alignment interval by performing the weighting. In the third exemplary embodiment, a method for adjusting the alignment interval by a method different from the weighting is described. Descriptions of configurations similar to those in the above-described first exemplary embodiment are omitted.

Figure 7:
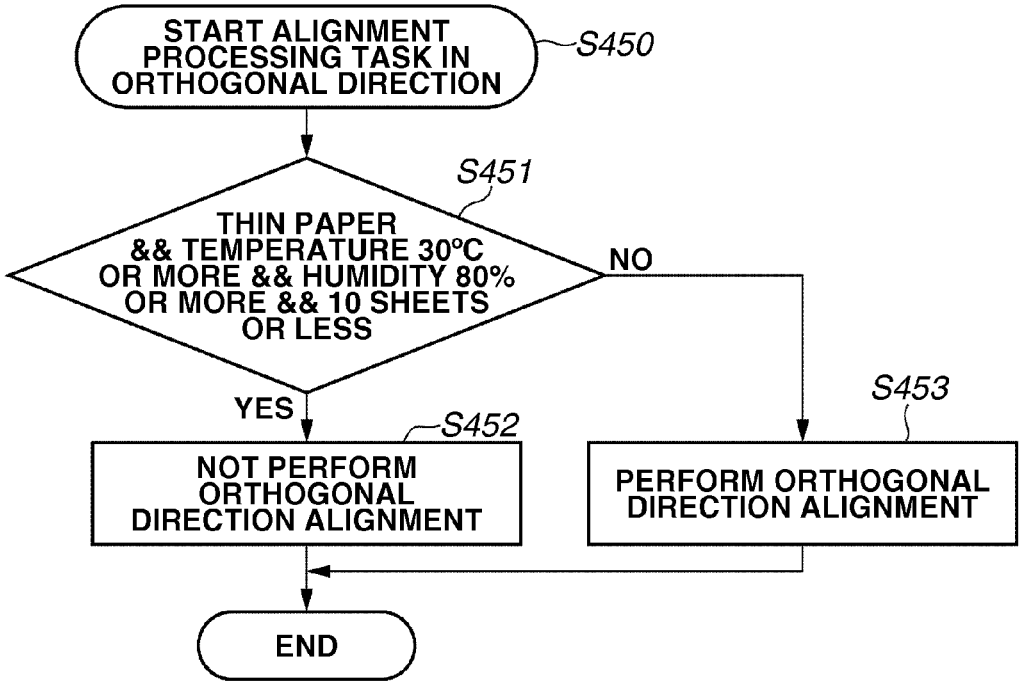
FIG. 7 is a flowchart illustrating an alignment processing task in the orthogonal direction according to a third exemplary embodiment.

With reference to the flowchart in FIG. 7, an alignment processing task in the orthogonal direction according to the exemplary embodiment is described. In step S451, the CPU 201 checks each condition of the paper type 205, the number of stacked sheets 206, the temperature 207, and the humidity 208. The CPU 201 checks whether the paper type 205 is thin paper, the number of stacked sheets 206 is 10 sheets or less, the temperature 207 is 30° C. or more, and the humidity 208 is 80% or more, respectively. If all conditions are satisfied (YES in step S451), the possibility that static clinging to the alignment member caused by electrostatic charge of the recording material may occur becomes high. Then, in step S452, the CPU 201 does not perform the alignment processing. If any one of the conditions is not satisfied (NO in step S451), in step S453, the CPU 201 performs the alignment processing.

In the description, as one example of the control, the alignment processing is not performed in the case where all of the above-described four conditions are satisfied. However, for example, it is possible to provide a setting for performing no alignment processing if two of the four conditions are satisfied. In such a case, the fact that the paper type 205 is thin paper is an important condition for the factors of the static clinging to the alignment member. Accordingly, it is preferable to add at least the condition that the paper type is thin paper to the determination conditions. Further, as described in the first exemplary embodiment, the numerical values used to determine the conditions are only one example, and the numerical values can be set to certain values within a range similar to that in the first exemplary embodiment.

As described above, the number of stacked sheets of the recording material until the alignment processing is controlled depending on the number of sheets of the recording material stacked on the alignment member in addition to the type of the recording material and the states of the environment, so that static clinging to the alignment member caused by electrostatic charge of the recording material due to the alignment processing can be reduced, and the alignment failure of the recording materials can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-165304 filed Jul. 22, 2010, which is hereby incorporated by reference herein in its entirety.

What is claimed is:

1. An image forming apparatus, comprising:

an image forming unit configured to form an image on a recording material having a type;

a stacking unit configured to stack the recording material on which the image is formed by the image forming unit;

an alignment unit configured to align an end of the recording material stacked by the stacking unit;

a detection unit configured to detect the type of the recording material; and a control unit configured to control, in a case where first recording materials are stacked by the stacking unit, a timing for an alignment operation to cause the alignment unit to perform the alignment operation when a first number of the first recoding materials are stacked, and to control, in a case where second recording materials, being thinner than the first recording materials, are stacked by the stacking unit, the timing of the alignment operation to cause the alignment unit to perform the alignment operation when a second number, being larger than the first number, of the second recoding materials are stacked.

wherein the control unit controls a number of stacked recording materials to be aligned by the alignment unit based on a condition that includes the type of the recording material detected by the detection unit, a number of sheets of the recording material stacked on the stacking unit, a temperature of an environment where the image forming apparatus is installed, and a humidity of the environment where the image forming apparatus is installed.

2. An image forming apparatus according to claim 1, wherein the control unit further controls the number of stacked recording materials to be aligned by the alignment based on a value obtained by adding a weight value corresponding to each condition.

3. An image forming apparatus according to claim 2, wherein the control unit controls the weight value corresponding to the type of the recording material to a value greater than the weight value for conditions other than the type of the recording material.

4. An image forming apparatus according to claim 1, wherein the control unit decreases a number of stacked recording materials to be aligned by the alignment unit in a case where a total number of recording materials stacked by the stacking unit is increased.

5. An image forming apparatus according to claim 1, wherein aligning an end of the recording material includes aligning an end of the recording material in a direction orthogonal to a conveyance direction of the recording material by the alignment unit.

6. A post-processing device, comprising:

a stacking unit configured to stack a recording material on which an image is formed;

an alignment unit configured to align an end of the recording material stacked by the stacking unit;

a detection unit configured to detect the type of the recording material; and a control unit configured to control, in a case where first recording materials are stacked by the stacking unit, a timing for an alignment operation to cause the alignment unit to perform the alignment operation when a first number of the first recoding materials are stacked, and to control, in a case where second recording materials, being thinner than the first recording materials, are stacked by the stacking unit, the timing of the alignment operation to cause the alignment unit to perform the alignment operation when a second number, being larger than the first number, of the second recoding materials are stacked, wherein the control unit controls a number of stacked recording materials to be aligned by the alignment unit based on a condition that includes the type of the recording material detected by the detection unit, a number of sheets of the recording material stacked on the stacking unit, a temperature of an environment where the image forming apparatus is installed, and a humidity of the environment where the image forming apparatus is installed.

7. An image forming apparatus, comprising:

an image forming unit configured to form an image on a recording material;

a stacking unit configured to stack the recording material on which the image is formed by the image forming unit;

an alignment unit configured to align an end of the recording material stacked by the stacking unit; and a control unit configured to control, in a case where a first number of recording materials are stacked by the stacking unit, a timing of an alignment operation to cause the alignment unit to perform the alignment operation when a second number of recoding materials are further stacked by the stacking unit, and to control, in a case where a third number of recoding materials, being larger than the first number, are stacked by the stacking unit, the timing of the alignment operation to cause the alignment unit to perform the alignment operation when a fourth number of recording materials, being larger than the second number, is further stacked by the stacking unit.

8. A post-processing device, comprising:

a stacking unit configured to stack a recording material on which an image is formed;

an alignment unit configured to align an end of the recording material stacked by the stacking unit; and a control unit configured to control, in a case where a first number of recording materials are stacked by the stacking unit, a timing of an alignment operation to cause the alignment unit to perform the alignment operation when a second number of recoding materials are further stacked by the stacking unit, and to control, in a case where a third number of recoding materials, being larger than the first number, are stacked by the stacking unit, the timing of the alignment operation to cause the alignment unit to perform the alignment operation when a fourth number of recording materials, being larger than the second number, is further stacked by the stacking unit.

9. An image forming apparatus, comprising:

an image forming unit configured to form an image on a recording material having a type;

a stacking unit configured to stack the recording material on which the image is formed by the image forming unit;

a control unit configured to set a predetermined number of sheets, the predetermined number is a number that corresponds to the type of the recording material; and an alignment unit configured to align an end of the recording material if the predetermined number of sheets of the recording material is stacked by the stacking unit, a detection unit configured to detect the type of the recording material, wherein the control unit controls the predetermined number of sheets based on a condition that includes the type of the recording material detected by the detection unit, a number of sheets of the recording material stacked on the stacking unit, a temperature of an environment where the image forming apparatus is installed, and a humidity of the environment where the image forming apparatus is installed.

* * * * *